US007289115B2

(12) United States Patent
Willis

(10) Patent No.: US 7,289,115 B2
(45) Date of Patent: Oct. 30, 2007

(54) LCOS AUTOMATIC BIAS FOR COMMON IMAGER ELECTRODE

(75) Inventor: Donald Henry Willis, Indianapolis, IN (US)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 09/950,988

(22) Filed: Sep. 13, 2001

(65) Prior Publication Data

US 2002/0097206 A1 Jul. 25, 2002

Related U.S. Application Data

(60) Provisional application No. 60/263,487, filed on Jan. 23, 2001.

(51) Int. Cl.
*G09G 3/18* (2006.01)
*G09G 3/36* (2006.01)
*G09G 5/00* (2006.01)

(52) U.S. Cl. ..... 345/206; 345/50; 345/87; 345/208; 345/211

(58) Field of Classification Search ..... 345/98, 345/204, 206, 96, 211, 50–54
See application file for complete search history.

(56) References Cited

U.S. PATENT DOCUMENTS

| | | | | |
|---|---|---|---|---|
| 5,283,477 | A * | 2/1994 | Shibata | 327/306 |
| 5,528,256 | A * | 6/1996 | Erhart et al. | 345/96 |
| 5,926,162 | A * | 7/1999 | Wood et al. | 345/101 |
| 5,929,847 | A * | 7/1999 | Yanagi et al. | 345/204 |
| 6,002,384 | A * | 12/1999 | Tamai et al. | 345/95 |
| 6,067,066 | A * | 5/2000 | Kubota et al. | 345/98 |
| 6,297,813 | B1 * | 10/2001 | Okada et al. | 345/204 |
| 6,504,521 | B1 * | 1/2003 | Inoue et al. | 345/89 |
| 6,509,895 | B2 * | 1/2003 | Yanagi et al. | 345/211 |
| 6,940,481 | B2 * | 9/2005 | Konno et al. | 345/96 |

* cited by examiner

*Primary Examiner*—Henry N Tran
(74) *Attorney, Agent, or Firm*—Joseph J. Laks; Harvey D. Fried

(57) ABSTRACT

A circuit for automatically biasing a common electrode of a liquid crystal on silicon imager comprising an imager with a common electrode and a plurality of cells. A varying voltage signal is provided to the plurality of cells. A low pass filter is coupled between the varying voltage signal and a common junction coupled to the common electrode such that a bias voltage is formed at the common electrode having a value that approximates an average of the varying voltage signal.

4 Claims, 1 Drawing Sheet

LCOS AUTOMATIC BIAS FOR COMMON IMAGER ELECTRODE

CROSS REFERENCE RELATED APPLICATION

This is a non-provisional application of provisional application Ser. No. 60/263,487, filed Jan. 23, 2001.

FIELD OF THE INVENTION

The invention arrangements relate to the field of LCOS (liquid crystal on silicon) and/or LCD (liquid crystal display) for video projection systems.

BACKGROUND OF THE INVENTION

LCOS can be thought of as one large liquid crystal formed on a silicon wafer. The silicon wafer is divided into an incremental array of tiny plates. A tiny incremental region of the liquid crystal is influenced by the electric field generated by each tiny plate and the common plate. Each such tiny plate and corresponding liquid crystal region are together referred to as a cell of the imager. Each cell corresponds to an individually controllable pixel. A common plate electrode is disposed on the other side of the liquid crystal.

The drive voltages are supplied from plate electrodes on each side of the LCOS array. In the presently preferred LCOS system to which the inventive arrangements pertain, the common plate is always at a potential of 8 volts. Each of the other plates in the array of tiny plates is operated in two voltage ranges. For positive pictures, the voltage varies between 0 volts and 8 volts. For negative pictures the voltage varies between 8 volts and 16 volts.

The light supplied to the imager, and therefore supplied to each cell of the imager, is field polarized. Each liquid crystal cell rotates the polarization of the input light responsive to the RMS value of the electric field applied to the cell by the plate electrodes. Generally speaking, the cells are not responsive to the polarity (positive or negative) of the applied electric field. Rather, the brightness of each pixel's cell is generally only a function of the rotation of the polarization of the light incident on the cell. As a practical matter, however, it has been found that the brightness can vary by about 5% between the positive and negative field polarities for the same polarization rotation of the light. Such variation of the brightness can cause an undesirable flicker in the displayed picture.

In the case of either positive or negative pictures, as the field driving the cells approaches a zero field, corresponding to 8 volt, the closer each sell comes to white, corresponding to a full on condition. Other systems are possible, for example where the common voltage is set to 0 volts. It will be appreciated that the inventive arrangements taught herein are applicable to all such positive and negative field LCOS imagar driving systems. Pictures are defined as positive pictures when the voltage applied to the common plate electrode a greater than or equal to the largest possible value in the range of the variable plate voltages in the array of the other electrode. Conversely, pictures are defined as negative pictures when the voltage applied to the common plate electrode is less than or equal to the smallest possible value in the range of the variable plate voltages in the array of the other electrode. The phrase "plate voltages" as used herein refers to source voltages applied to plate electrodes of the LCOS array. The designation of pictures as positive or negative should not be confused with terms used to distinguish field types in interlaced video formats.

It is typical to drive the imager of an LCOS display with a frame-doubled signal by sending first a normal frame (positive picture) and then an inverted frame (negative picture) in response to a given input picture. The generation of positive and negative pictures ensures that each pixel will be written with a positive electric field followed by a negative electric field. The resulting drive field has a zero DC component, which is necessary to avoid the image sticking, and ultimately, permanent degradation of the imager. It has been determined that the human eye responds to the average value of the brightness of the pixels produced by these positive and negative pictures.

The present state of the art in LCOS requires the adjustment of the common electrode voltage, denoted $V_{ITO}$ or sometimes $V_{COM}$, to be precisely between the positive and negative field drive for the LCOS. The balance is necessary in order to minimize flicker, as well as to prevent a phenomenon known as image sticking.

In the prior art it is often tricky to properly bias the common electrode in an imager. Usually, it is done by guesswork. As noted above, when the bias voltage is not optimal there can be image sticking, flicker, and in extreme cases, damage to the imager. Typically, the dynamic range of the positive and negative pictures is chosen and Vito is biased half way between them. This undesirably ignores the details of the gamma correction tables, non-linearity in the anolog circuts, and drift with temperature and age.

SUMMARY OF THE INVENTION

In accordance with a first aspect of the present invention and with reference to FIG. 1, a circuit 10 for automatically biasing the voltage to a common electrode in a liquid crystal on silicon imager 15 comprises an imager having a common electrode Ce and a plurality of cells 17 in the imager. The circuit 10 further comprises a voltage signal source 12 provided to the plurality of cells 17, a resistive load 16 providing resistance between voltage signal 12 and a common junction 13, and a capacitive load 18 providing capacitance between the common junction 13 and a point of reference potential. The common junction 13 is coupled to the common electrode Ce such that the voltage ($V_{ito}$) at the common electrode is a bias voltage having a value that approximates to an average value of voltage signal 12.

FIG. 2 illustrates the steps in the method of applying a bias voltage to a common electrode where the bias voltage is equal to the average of the overall voltages of each phase taken over one cycle of positive and negative images.

DETAILED DESCRIPTION OF THE INVENTION

The improved automatic bias scheme in accordance with the inventive arrangements does not ignore the details noted above, and is shown in FIG. 1. In the preferred embodiment, a four-phase imager is driven with four analog voltage signals Φ1-Φ4 to write all the pixels of both the positive frame and the negative frame. In the present state of the art, four phases are needed because a single 12, phase would require an excessively high analog sample rate and thus, too high a slew rate. Each phase carries every fourth pixel, so a demultiplexer 14 is preferably used in this instance to generate the four phases. The invention, however, is not limited to a phased voltage signal, as the future advancement of the art may obviate the requirement for a phased voltage signal and the use of the demultiplexer 14.

Figure 1:
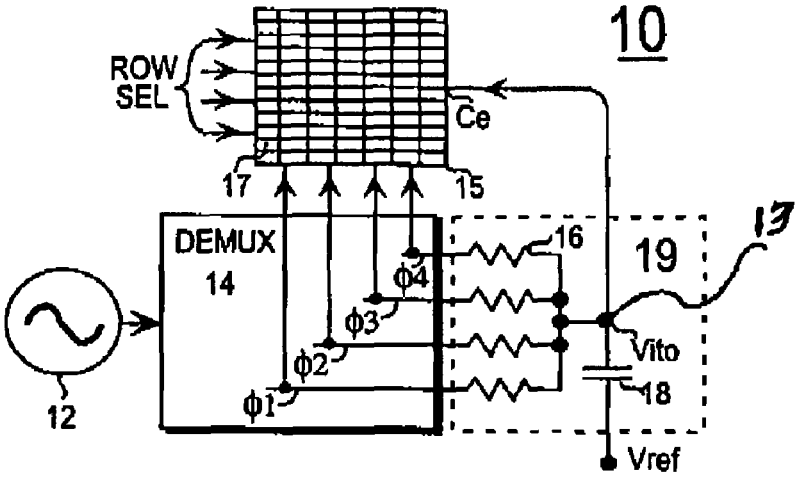
FIG. 1 is a circuit diagram showing the voltage averaging components of the invention.

In FIG. 1, the improved bias circuit 10 averages all four signals Φ1-Φ4 by use of a low pass filter 19 formed by four equal value resistors 16, and a capacitor 18. The low pass filter network provides a long time constant with heavy low-pass filtering of the resulting combined voltage Vito. This voltage, Vito is suitable for biasing the common electrode of imager 15. Of course, buffers and feedback arrangements (not shown) can be used if the voltage developed has too high an impedance, but these embellishments are variations on the basic scheme of the inventive arrangements.

The values chosen for this circuit are relatively easy to select if the load impedance of the common plate or electrode Ce is very high. For example, each of the four resistors 16 can have a value of 1 megohm. The capacitor 18 is then selected to provide a time constant such as to substantially eliminate any expected AC voltage component for junction 13 and the common electrode. A value of 10 microfarads may be appropriate to achieve this function for a frame rate of 120 Hz. Voltages in the circuit are measured with respect to a point of reference potential, $V_{ref}$. In some configurations, this reference potential may constitute a ground.

Figure 2:
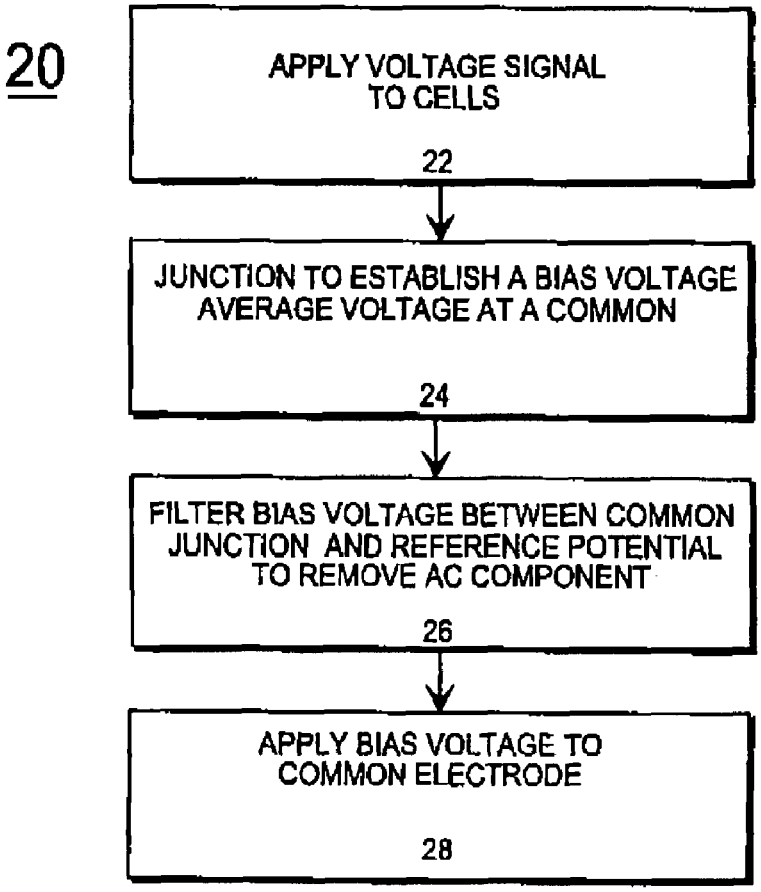
FIG. 2 is a flow chart illustrating a method in accordance with the present invention.

In accordance with a second aspect of the present invention and with reference to FIG. 2, a method 20 of applying voltage bias to a common electrode in a liquid crystal on silicon imager preferably comprises the step 22 of applying a varying voltage signal to a plurality of cells in an imager, and the step 24 of averaging the voltage of the voltage signal by placing a resistive load between the voltage signal and a common junction such that there is a bias voltage at the common junction. The method 20 further comprises the step 26 of filtering the bias voltage through a capacitive medium between the common junction and a point of reference potential to remove alternating current components, and the step 28 of applying the bias voltage to a common electrode.

The methods and apparatus illustrated herein teach how a common imager electrode may be biased to a voltage that is an overall average of the voltages of all cells in the imager. It will be understood that this invention is not limited to the specific embodiments shown and disclosed herein, and that other modifications may be made to the embodiments within the principles of the invention as recited in the appended claims. For example, with regard to the multiple phase voltage, there may be any number of phases from one to ten or more. The same is true with regard to the resistance—capacitance circuit or the resistive and capacitive loads, which may involve other components values or time constants as necessary to achieve the desired bias voltage filtering without a substantial AC component.

Although the present invention has been described in conjunction with the embodiments disclosed herein, it should be understood that the foregoing description is intended to illustrate and not limit the scope of the invention as defined by the claims.

What is claimed is:

1. A liquid crystal on silicon (LCOS) imager comprising:

a plurality of cells, each cell including a first electrode comprising a common electrode and a second electrode;

a voltage source providing at least two analog voltage signals to respective second electrodes of said cells, said at least two analog voltage signals representing pictures of positive and negative images, said at least two analog voltage signals having different phases;

respective resistors coupled between said second electrodes and said common electrodes; and a capacitor coupled between said common electrode and a reference potential;

wherein said at least two analog voltage signals vary from approximately zero volts to approximately eight volts to create said positive images, and from approximately eight volts to approximately 16 volts to create said negative images, said positive images and said negative images being alternately applied to said plurality of cells, and wherein said common electrode receives a bias voltage approximating an overall average value of said at least two analog voltage signals.

2. The imager of claim 1 wherein said voltage source provides four analog voltage signals and wherein each of said respective resistors are equal in resistance value.

3. The imager of claim 1 further including a demultiplexer coupled to said voltage source to provide said at least two analog voltage signals to said respective second electrodes.

4. A method of applying a bias voltage to a common electrode of cells of a liquid crystal on silicon imager, comprising the steps of providing at least two analog voltage signals representing pictures to corresponding respective second electrodes of said cells;

varying said at least two analog voltage signals from approximately zero volts to approximately eight volts to create a positive image and approximately eight volts to approximately 16 volts to create a negative image;

filtering said at least two analog voltage signals by placing a resistive load between a voltage source that supplies said at least two analog voltage signals and said common electrode;

applying a bias voltage to said common electrode comprising an average of said at least two analog voltage sigals;

alternately applying said positive image and said negative image to said plurality of cells.

* * * * *